US008574115B2

(12) United States Patent
Atsumi et al.

(10) Patent No.: US 8,574,115 B2
(45) Date of Patent: Nov. 5, 2013

(54) ELECTRIC POWER TOOL

(75) Inventors: Masatoshi Atsumi, Hikone (JP); Yutaka Yamada, Hikone (JP); Kenichiro Inagaki, Hikone (JP)

(73) Assignee: Panasonic Corporation (JP)

( * ) Notice: Subject to any disclaimer, the term of this patent is extended or adjusted under 35 U.S.C. 154(b) by 141 days.

(21) Appl. No.: 13/067,709

(22) Filed: Jun. 22, 2011

(65) Prior Publication Data

US 2012/0028753 A1 Feb. 2, 2012

(30) Foreign Application Priority Data

Jul. 29, 2010 (JP) ..... 2010-170893

(51) Int. Cl.
*F16H 3/46* (2006.01)

(52) U.S. Cl.
USPC ..... 475/299; 475/320

(58) Field of Classification Search
USPC ..... 475/298, 299, 320, 303; 173/216; 192/69.9, 69.83, 93 A, 109 A
See application file for complete search history.

(56) References Cited

U.S. PATENT DOCUMENTS

| | | | | |
|---|---|---|---|---|
| 3,872,955 | A * | 3/1975 | McIntyre | 192/69.9 |
| 4,753,331 | A * | 6/1988 | Dietenberger et al. | 192/69.9 |
| 7,044,882 | B2 * | 5/2006 | Eisenhardt | 475/298 |
| 7,308,948 | B2 | 12/2007 | Furuta | |
| 7,479,084 | B2 * | 1/2009 | Alfredsson | 475/209 |
| 2002/0098938 | A1 | 7/2002 | Milbourne et al. | |
| 2008/0161150 | A1 * | 7/2008 | Hagan et al. | 475/298 |

FOREIGN PATENT DOCUMENTS

| | | |
|---|---|---|
| EP | 2030710 A2 | 3/2009 |
| JP | 63-101545 | 5/1988 |
| JP | 2006-123081 A | 5/2006 |

OTHER PUBLICATIONS

European Search Report dated Aug. 27, 2013.

* cited by examiner

*Primary Examiner* — Sherry Estremsky
(74) *Attorney, Agent, or Firm* — Bacon & Thomas, PLLC

(57) ABSTRACT

An electric power tool includes a cylindrical reducer case accommodating the speed reduction mechanism. The speed reduction mechanism includes a planetary gear train and a movable member which is axially slidable to be engaged with or disengaged from the planetary gear train. The electric power tool includes the reducer case including a slide hole formed through a sidewall of the reducer case and axially extended and a rotary plate which is rotatable around a periphery of the reducer case about the axis, the rotary plate including an operation slot formed axially obliquely and overlapped with the slide hole; a supporting member radially outwardly protruded from the movable member and extended through the slide hole and the operation slot; and a biasing unit for applying a pressing force to the supporting member in a moving direction of the supporting member when the rotary plate is rotated to a position.

8 Claims, 12 Drawing Sheets

ELECTRIC POWER TOOL

FIELD OF THE INVENTION

The present invention relates to an electric power tool; and, more particularly, to an electric power tool including a planetary gear train capable of changing a reduction ratio at a plurality of stages.

BACKGROUND OF THE INVENTION

Conventionally, there has been disclosed an electric power tool including a planetary gear train and a movable member configured to be engaged with and disengaged from the planetary gear train. The electric power tool can shift the gears at a plurality of stages by controlling the movement of the movable member (see, e.g., Japanese Patent Application Publication No. S63-101545).

As such kind of an electric power tool, there has been provided an electric power tool including a speed reduction mechanism shown in FIGS. 7A to 7C, for an example. The electric power tool includes a carrier 90 having a plurality of teeth arranged in the circumferential direction; a planet gear 91 which is engaged with an output gear of the carrier 90; and a ring gear 92 having a plurality of teeth which is engaged with the carrier 90 and the planet gear 91. The ring gear 92 is axially slidable to be engaged with and disengaged from the teeth of the carrier 90.

Specifically, the ring gear 92 is movable between a position shown in FIG. 7A where the teeth thereof are engaged with the carrier 90 and the planet gear 91, and a position shown in FIG. 7C where the teeth thereof are disengaged from the carrier 90 and engaged with the planet gear 91 and another gear 93. In this example, the gear 93 has teeth that are radically inwardly extended, and the gear 93 is fixed to a reducer case. The teeth of the gear 93 are configured to be engaged with outer teeth formed on the outer periphery of the ring gear 92.

In the electric power tool, the ring gear 92 serves as the movable member. The electric power tool can shift the gears at a plurality of stages by controlling the axial movement of the movable member to change a reduction ratio thereof.

In the meantime, when the movable member slides and is disengaged from the carrier 90 and engaged with the gear 93 in the electric power tool, the teeth of the movable member and the gear 93 are reliably engaged with each other in case each of the teeth of the movable member is positioned between the adjacent teeth of the gear 93. However, when facing surfaces of the teeth of the movable member and the gear 93 are brought into contact with each other, the movable member stops sliding and is locked at the position where the facing surfaces of the teeth of the movable member and the gear 93 are made contact with each other (see FIG. 7B). In this case, it is difficult for the electric power tool to change the reduction ratio.

SUMMARY OF THE INVENTION

In view of the above, the present invention provides an electric power tool capable of reliably changing a reduction ratio by reliably controlling a movable member to be engaged with a target gear when the reduction ratio is changed.

In accordance with an aspect of the present invention, there is provided an electric power tool including a motor accommodated in a housing and serving as a drive power source; a speed reduction mechanism for transferring a rotational driving force to a tool part provided at a front side of the housing;

and a cylindrical reducer case, accommodated in the housing and accommodating therein the speed reduction mechanism, where the speed reduction mechanism includes a planetary gear train and a movable member which is slidable in an axial direction of the planetary gear train to be engaged with or disengaged from the planetary gear train, and a reduction ratio thereof is changeable at a plurality of stages by controlling the movement of the movable member. The electric power tool further includes: the reducer case including a slide hole formed through a sidewall of the reducer case and extended along the axial direction; a rotary plate which is rotatable around a periphery of the reducer case about the axis, the rotary plate including an operation slot extended obliquely with respect to the axial direction and overlapped with the slide hole; a supporting member radially outwardly protruded from the movable member and extended through the slide hole and the operation slot; a driving unit for driving the rotary plate along the periphery of the reducer case; and a biasing unit for applying a pressing force to the supporting member in a moving direction of the supporting member when the rotary plate is rotated to a position by the driving unit.

The biasing unit may generate the pressing force when the movable member is unable to be moved immediately before reaching a changeover position.

The biasing unit may be an elastic body provided at a side of the operation slot, exclusive of longitudinal opposite ends of the operation slot.

An elastic force applying groove may be formed along the operation slot to form a thin part between the operation slot and the elastic force applying groove, and the thin part serves as the biasing unit.

The biasing unit may include a pair of magnets respectively provided at one circumferential end of the rotary plate and a portion of the reducer case such that they are opposite to each other.

With the electric power tool of the present invention, it is possible to reliably change a reduction ratio by reliably allowing its movable member to be engaged with a target gear when the reduction ratio is changed.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Embodiments of the present invention will now be described with reference to the accompanying drawings which form a part hereof. Further, for the convenience of description, the direction along an axis of a speed reduction mechanism 2 is defined as the axial direction.

Figure 3:
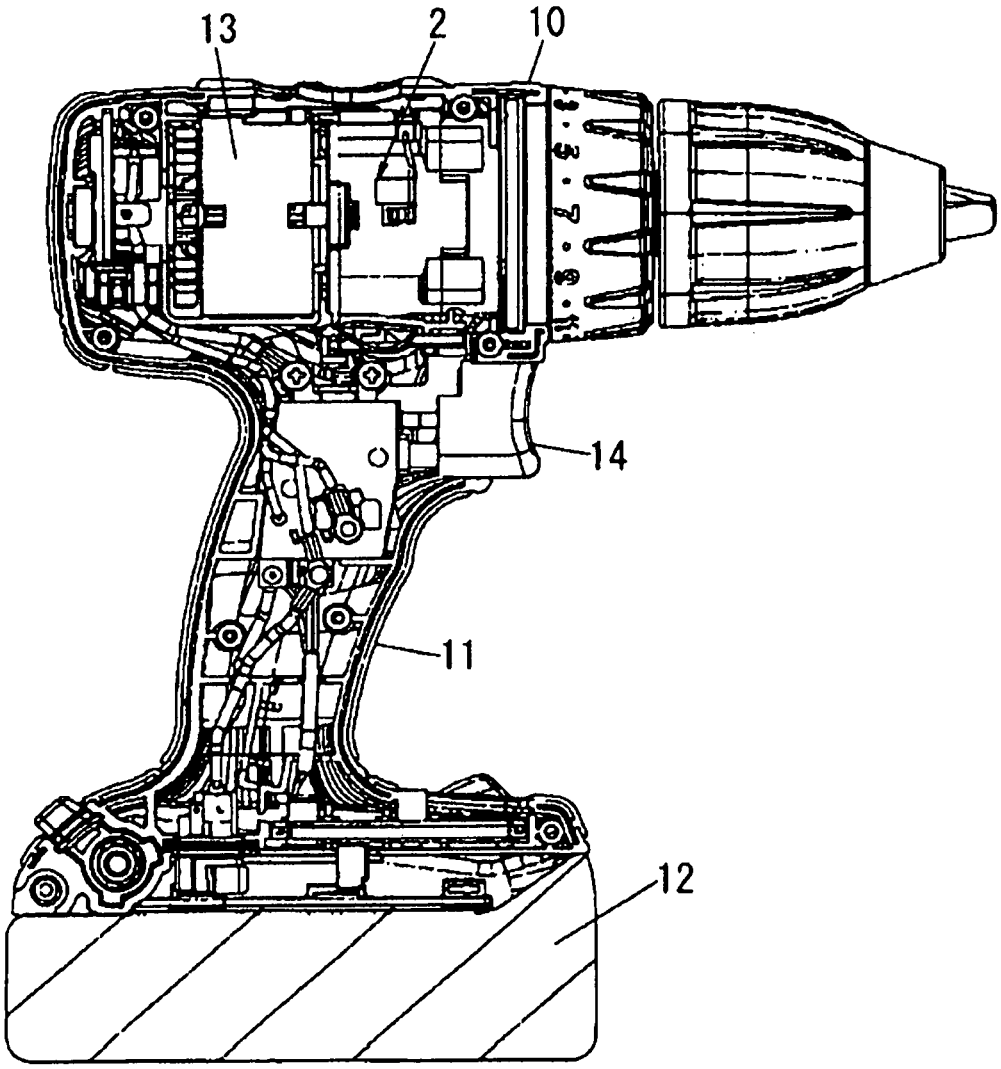
FIG. 3 is a side cross sectional view showing an entire electric power tool in accordance with the first embodiment.

As shown in FIG. 3, an electric power tool in accordance with a first embodiment of the present invention includes a cylindrical housing 10 and a handle 11 laterally extended from the housing 10, which together form an outer appearance of the electric power tool. The housing 10 includes therein a motor 13 serving as a drive power source; and a speed reduction mechanism 2 serving to reduce a rotational driving force of the motor 13 and transfer the reduced force to a tool part such as a driver bit or the like. The electric power tool further includes an electric pack 12 serving to supply a power to the motor 13; and a trigger switch 14 serving to control the power supplied to the motor 13.

The housing 10 further includes a reducer case 4, and the speed reduction mechanism 2 is accommodated in the reducer case 4. The speed reduction mechanism 2, as shown in FIG. 1, includes a plurality of planetary gear trains 21. The first planetary gear train 21 includes a sun gear 22 placed at an input side thereof and driven by the motor 13; a plurality of planet gears 23 arranged around the sun gear 22; a carrier 24 for rotatably holding the planet gears 23; and a ring gear 25 placed at a peripheral portion of the planet gears 23.

The carrier 24 has teeth radially outwardly protruding from its outer peripheral portion. The carrier 24 includes, at a central portion thereof, a central gear unit 26 serving as an input of the second planetary gear train 21. Planet gears 27 of the planetary gear train 21 are arranged around the central gear unit 26 of the carrier 24 of the first planetary gear train 21.

The planet gears 27 of the second planetary gear train 21 are rotatably held in place by a carrier 28 of the second planetary gear train 21. The carrier 28 of the second planetary gear train 21 includes a central gear unit 29 at a central portion of an output side thereof, and planet gears (of the third planetary gear train 21) are arranged around the central gear unit 29. The planet gears 30 are rotatably held in place by a carrier 36 of the third planetary gear train 21 and make an engagement with a ring gear 33 of the third planetary gear train 21, which is arranged outside the planet gears 30. The carrier 36 of the third planetary gear train 21 is configured to be rotated by the revolution of the planet gears 30 of the third planetary gear train 21. An output shaft (not shown) is protruded from a center portion of the carrier 36, and the rotational driving force is transferred to the output shaft.

As described above, the first planetary gear train 21 includes the ring gear 25 provided around the planetary gears 23. The ring gear 25 of the first planetary gear train 21 is fixed to the reducer case 4, whereby it is not rotated. The second planetary gear train 21 includes a ring gear 31 around the planet gears 27 of the second planetary gear train 21, the ring gear 31 being freely slidable along the axial direction.

The ring gear 31 of the second planetary gear train 21 includes teeth 320 radially inwardly protruding from its inner peripheral portion and teeth 321 radially inwardly recessed at an outer peripheral surface of an end portion of an output side thereof. The ring gear 31 of the second planetary gear train 21 is movable between a position, at which it is engaged with the teeth of the carrier 24 of the first planetary gear train 21 and the tooth of the corresponding planet gears 27 of the second planetary gear train 21, and a position at which it is engaged with the teeth of the planet gear 27 of the second planetary gear train 21 and a fixed teeth 41 radially inwardly protruded from the reducer case 4.

Figure 1A:
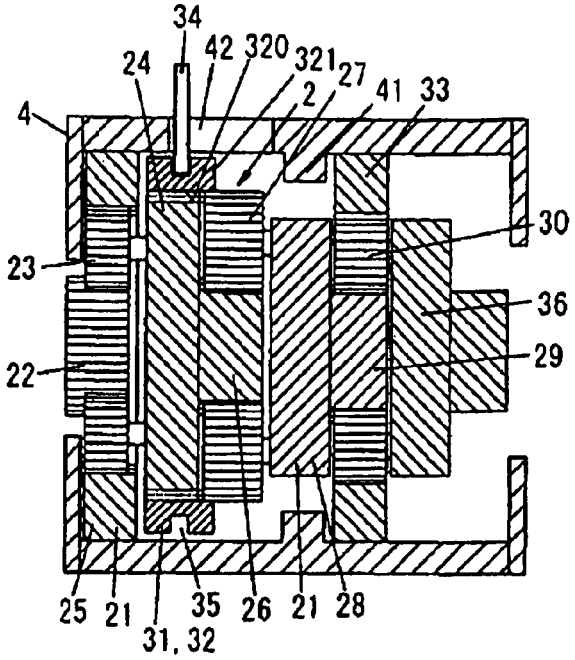
FIGS. 1A to 1C are cross sectional views showing main parts of a speed reduction mechanism in accordance with a first embodiment of the present invention.
Figure 1B:
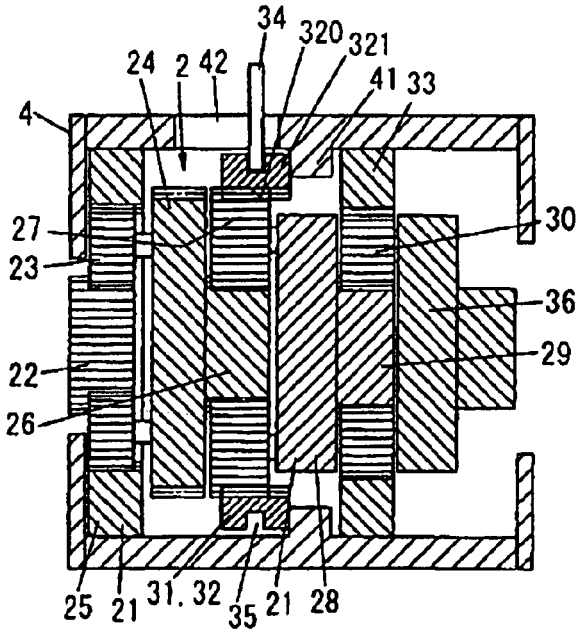
Figure 1C:
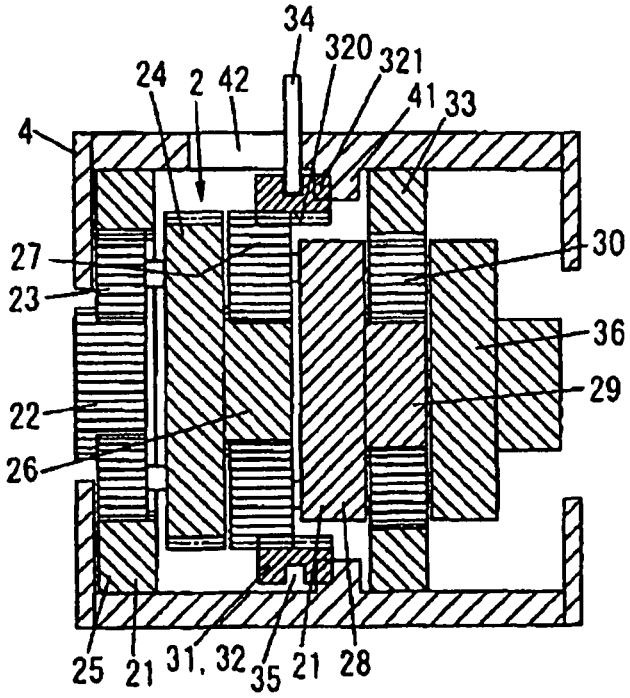

The electric power tool of the present embodiment is in a non-speed reduction mode when the ring gear 31 of the second planetary gear train 21 is engaged with the carrier 24 of the first planetary gear train 21 and the planet gears 27 of the second planetary gear train 21 (see FIG. 1A). Further, the electric power tool is in a speed reduction mode when the ring gear 31 of the second planetary gear train 21 is engaged with the planet gear 27 of the second planetary gear train 21 and the fixed teeth 41 (see FIG. 1C). In the electric power tool of the present embodiment, the ring gear 31 of the second planetary gear train 21 serves as the movable member. The ring gear 33 of the third planetary gear train 21 arranged around the outer periphery of the planet gears 30 of the third planetary gear train 21 is fixed to the reducer case 4.

The planetary gears 23 of the first planetary gear train 21, as shown in FIG. 1, make the engagements with the sun gear 22 and the ring gear 25 of the first planetary gear train 21. The planet gears 27 of the second planetary gear train 21 make the engagements with the central gear unit 26 of the carrier 24 of the first planetary gear train 21 and the ring gear 31 of the second planetary gear train 21. The planet gears 30 of the third planetary gear train 21 make the engagements with the central gear unit 29 of the carrier 28 of the second planetary gear train 21 and the ring gear 33 of the third planetary gear train 21.

The ring gear 31 of the second planetary gear train 21 includes a supporting member 34 radially outwardly protruding therefrom. The ring gear 31 is slidable by controlling the axial movement of the supporting member 34. In the present embodiment, the ring gear 31 of the second planetary gear train 21 has an annular groove 35 formed on its outer peripheral surface. One end of the supporting member 34 is accommodated in the groove 35, so that the ring gear 31 can be rotated while being moved by the axial movement of the supporting member 34. Further, the supporting member 34 is extended through a sidewall of the reducer case 4.

The reducer case 4 has a cylindrical shape and accommodates therein the speed reduction mechanism 2 having such configuration. A slide hole 42 having an axially elongated shape is formed through the sidewall of the reducer case 4 to correspond to the supporting member 34. The supporting member 34 is protruded through the slide hole 42 to the outside of the reducer case 4.

Figure 2A:
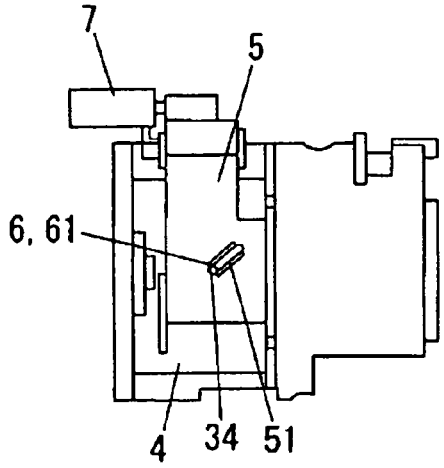
FIGS. 2A to 2C are side views showing main parts around a rotary plate in the first embodiment.
Figure 2B:
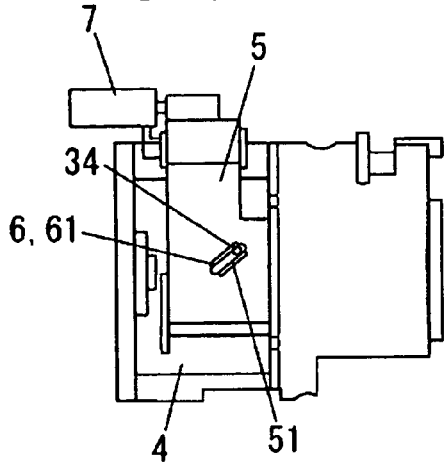
Figure 2C:
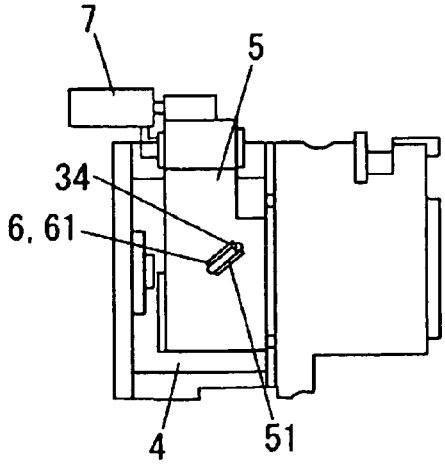

The electric power tool of the present embodiment, as shown in FIGS. 2A to 2C, further includes a rotary plate 5 that is rotatable around the periphery of the reducer case 4 about the axis thereof. The rotary plate 5 is formed with an operation slot 51 extended obliquely with respect to the axial direction (inclined by, e.g., about 45° with respect to the axial direction when viewed from the side). The rotary plate 5 is attached to the electric power tool such that the operation slot 51 is overlapped with the slide hole 42 of the reducer case 4. In other words, the supporting member 34 is extended through both of the slide hole 42 and the operation slot 51.

When the rotary plate 5 is rotated about the reducer case 4 about the axis thereof, the supporting member 34 is pressed by an edge of the operation slot 51 in the axial direction and thus moved along the slide hole 42. When the supporting member 34 is positioned at one end of the operation slot 51 in the longitudinal direction (see FIG. 2A), the ring gear 31 of the second planetary gear train 21 is engaged with the carrier 24 of the first planetary gear train 21 and the planet gear 27 of the second planetary gear train 21 (see FIG. 1A). When the supporting member 34 is positioned at the other end of the operation slot 51 in the longitudinal direction (see FIG. 2C), the ring gear 31 of the second planetary gear train 21 is engaged with the planet gear 27 of the second planetary gear train 21 and the fixed teeth 41 of the reducer case 4 (see FIG. 1C)

The rotary plate 5 includes a biasing unit 6. When the rotary plate 5 is rotated to a predetermined position, the biasing unit 6 applies a pressing force toward the supporting member 34 in the moving direction. Specifically, in case that the rotary plate 5 is rotated to a predetermined position, the pressing force is continuously applied toward the supporting member 34 when the ring gear 31 of the second planetary gear train 21 is unable to be moved by bringing the facing surfaces of the teeth thereof and the fixed teeth 41 into contact with each other. Further, in case that the rotary plate 5 is reversely rotated, the pressing force is continuously applied toward the supporting member 34 when the facing surfaces of the teeth thereof and the teeth of the carrier 24 of the first planetary gear train 21 into contact with each other so that the ring gear 31 of the second planetary gear train 21 is unable to be further moved.

Figure 4A:
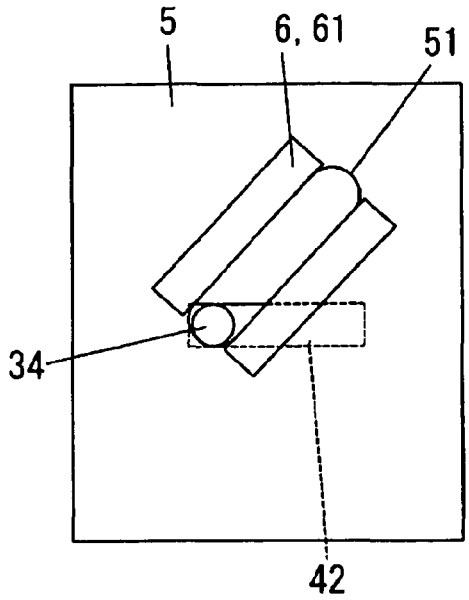
FIGS. 4A to 4C are enlarged views showing the rotary plate, an operation slot, a basing unit and a supporting member in the first embodiment.
Figure 4B:
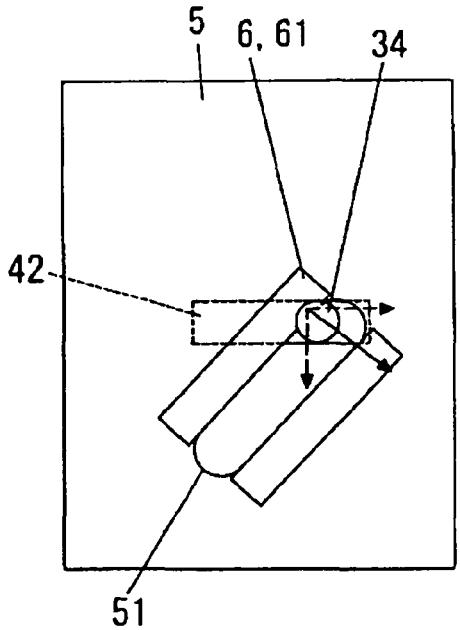
Figure 4C:
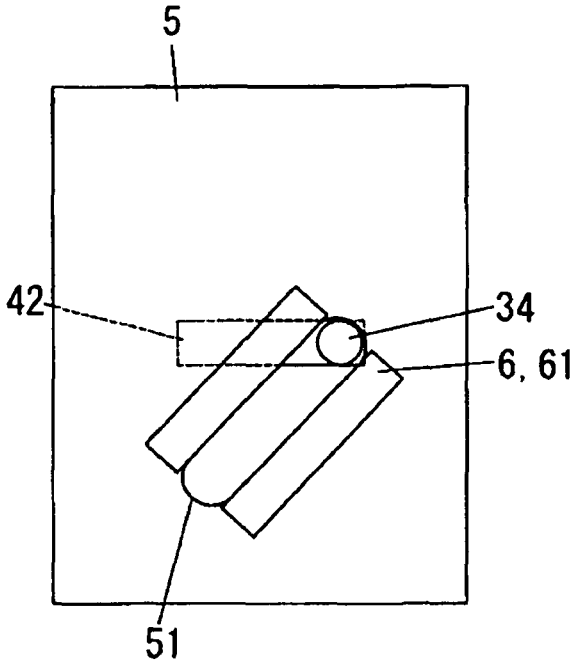

The biasing unit 6 of the present embodiment, as shown in FIGS. 4A to 4C, includes a pair of elastic bodies 61 respectively provided along opposite longer sides of the operation slot 51. The elastic bodies 61 are provided at the sides of the operation slot 51, exclusive of longitudinal opposite ends of the operation slot 51.

Facing surfaces of the elastic bodies 61 respectively serve as opposite longer sides of the operation slot 51. Each of the elastic bodies 61 has such an extent of hardness that the elastic bodies 61 are not significantly elastic-deformed by pressing the supporting member 34 in the state where the movable member 34 is moving. On the other hand, when the elastic bodies 61 press the supporting member 34 in the state where the movable member is unable to be moved, the elastic bodies 61 are pressed back by the supporting member 34, which causes the elastic bodies 61 to be elastically deformed. At this time, the elastic bodies 61 continuously apply the pressing force toward the supporting member 34 in the moving direction (toward a changeover position).

The electric power tool of the present embodiment further includes a driving unit for driving the rotary plate 5 about the axial. Specifically, the driving unit 7 drives the rotary plate 5 to reciprocate along the periphery of the reducer case 4 in a predetermined range. The driving unit 7 of the present embodiment includes a small motor capable of forward and backward rotation.

The electric power tool of such configuration can shift the gears at a plurality of stages having different reduction ratios. The reduction ratios are changed as follows.

In order to change from the non-speed reduction mode to the speed reduction mode, the rotary plate 5 is rotated by the driving unit 7 from the position shown in FIG. 2A to the position shown in FIG. 2C. Then, the supporting member 34 pressed by the operation slot 51 of the rotary plate 5 is moved along the slide hole 42. At this time, the ring gear 31 of the second planetary gear train 21 is also moved by the movement of the supporting member 34.

When the ring gear 31 of the second planetary gear train 21 comes to the contact with the fixed teeth 41, the ring gear 31 becomes unable to be moved due to the fixed teeth 41, while the rotary plate 5 is continuously rotated. This causes one of the elastic bodies 61 provided at the sides of the operation slot 51 to be elastically deformed, thereby generating a restoration force, by which the elastic bodies 61 continuously press the supporting member 34 toward the fixed teeth 41.

At this time, if the motor 13 serving as the drive power source is operated, the ring gear 31 of the second planetary gear train 21 is rotated while being pressed by the elastic body 61. Then, the ring gear 31 of the second planetary gear train 21 is rotated relative to the fixed teeth 41 in the state where their facing surfaces make contact with each other. The ring gear 31 is rotated to the position where the tooth of the ring gear 31 are engaged with the fixed tooth 41 and then moved into the changeover position by the pressing force applied from the elastic body 61. Accordingly, since the ring gear 31 of the second planetary gear train 21 and the fixed teeth 41 are engaged with each other and the rotation of the ring gear 31 is restricted, the rotation of the output shaft is reduced and the electric power tool is changed from the non-speed reduction mode to the speed reduction mode.

The change from the speed reduction mode to the non-speed reduction mode is performed in a reverse order, and thus description thereof will be omitted herein. In this case, the member that is engaged with the teeth of the ring gear 31 of the second planetary gear train 21 is the teeth of carrier 24 of the first planetary gear train 21, and the state becomes same as the case when the pressing direction of the movable member 32 is reversed.

In the electric power tool of such configuration, when the reduction ratio is changed, the supporting member 34 is continuously pressed in the moving direction thereof even if the movable member 32 is temporarily unable to be moved due to the contact with the facing surface of a target member to be engaged therewith (e.g., the fixed teeth 41 or the teeth of the carrier 24 of the first planetary gear train 21). Accordingly, even when the facing surfaces of the movable member 32 and the target member are not aligned to each other, it is possible to make the engagement of the movable member 32 with the target member. As a result, it is possible to reliably allow the movable member 32 and the target member to be engaged with each other.

The biasing unit 6 of the present embodiment generates a pressing force when the movable member 32 becomes unable to be moved immediately before reaching the changeover position. Accordingly, it is possible to reliably change the reduction ratio without generating an unnecessary force. Further, since the biasing unit 6 includes the elastic bodies 61, it is possible to provide the electric power tool having a simple structure without scaling up the electric power tool.

Figure 5A:
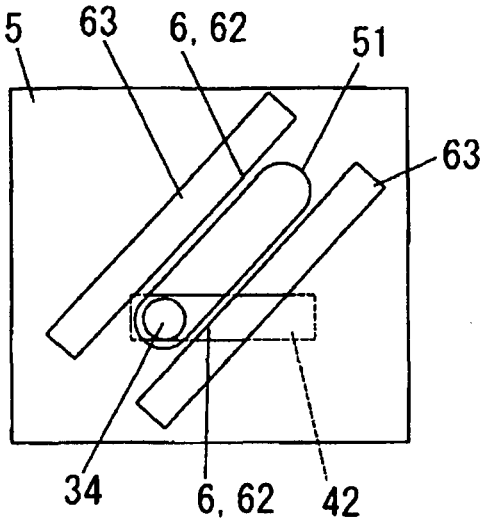
FIGS. 5A to 5C are enlarged views showing a rotary plate, an operation slot, a basing unit and a supporting member in accordance with a second embodiment of the present invention.
Figure 5B:
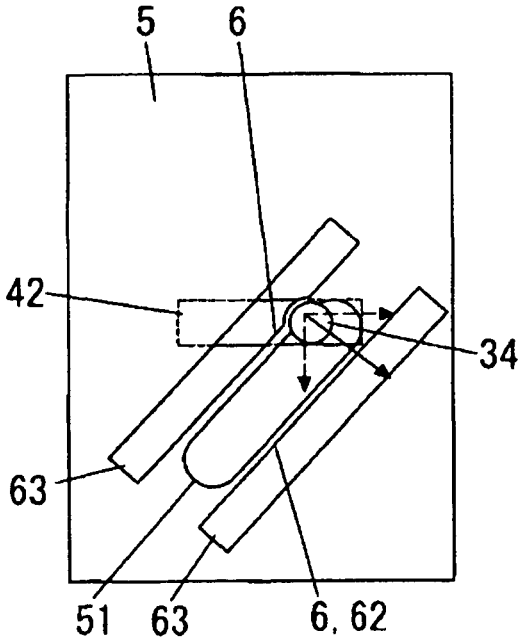
Figure 5C:
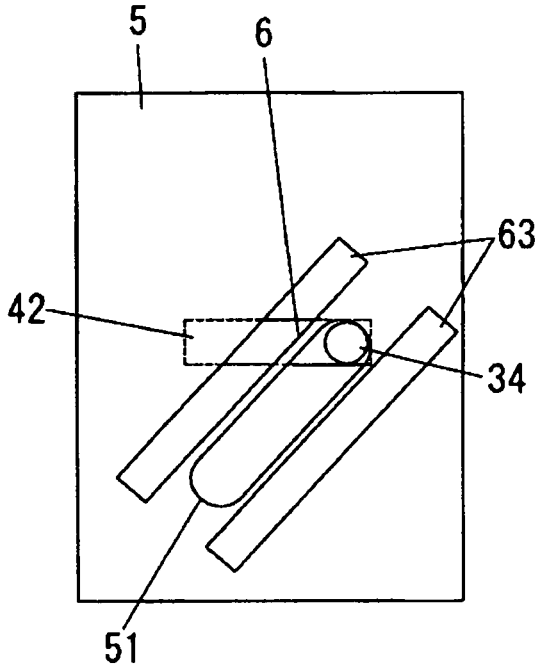

Next, a second embodiment of the present invention will be described with reference to FIGS. 5A to 5C. Since the second embodiment has the same structure as that of the first embodiment except for the configuration of the biasing unit 6, the difference therebetween will mainly be described without the redundant descriptions.

In the electric power tool in accordance with the second embodiment, the biasing unit 6 includes a pair of elastic force applying grooves 63 formed along the operation slot 51 of the rotary plate 5. The elastic force applying grooves 63 are provided at opposite sides of the operation slot 51 such that the operation slot 51 is arranged therebetween. The elastic force applying grooves 63 are arranged in substantially parallel with the operation slot 51, and thin parts 62 are respectively formed between the operation slot 51 and the elastic force applying grooves 63.

The thin parts 62 can be elastically deformable toward the elastic force applying grooves 63, and a restoring force when they are deformed.

Accordingly, it is possible to continuously press the supporting member 34 in the moving direction thereof even when the movable member 32 is temporarily unable to be moved due to the contact with the facing surface of a target member to be engaged therewith (e.g., the fixed teeth 41 or the teeth of the carrier 24 of the first planetary gear train 21). As a result, it is possible to reliably allow the movable member 32 and the target member to be engaged with each other.

Further, since the biasing unit 6 includes the thin parts 62 formed by the elastic force applying grooves 63, it is not necessary to provide an additional member such as the elastic bodies 61 or the like in the electric power tool of the present embodiment. Accordingly, it is possible to reduce the number of components.

Figure 6A:
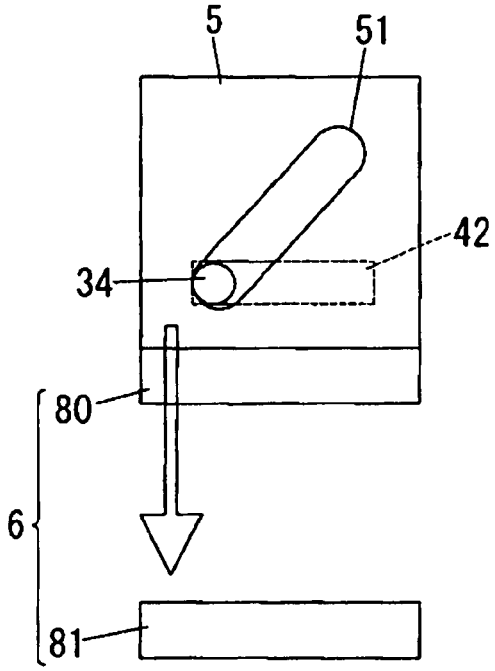
FIGS. 6A to 6C are enlarged views showing a rotary plate, an operation slot, a basing unit and a supporting member in accordance with a third embodiment of the present invention.
Figure 6B:
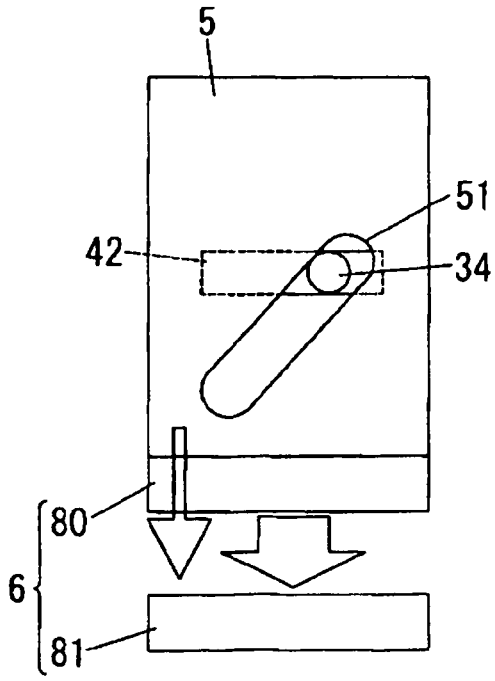
Figure 6C:
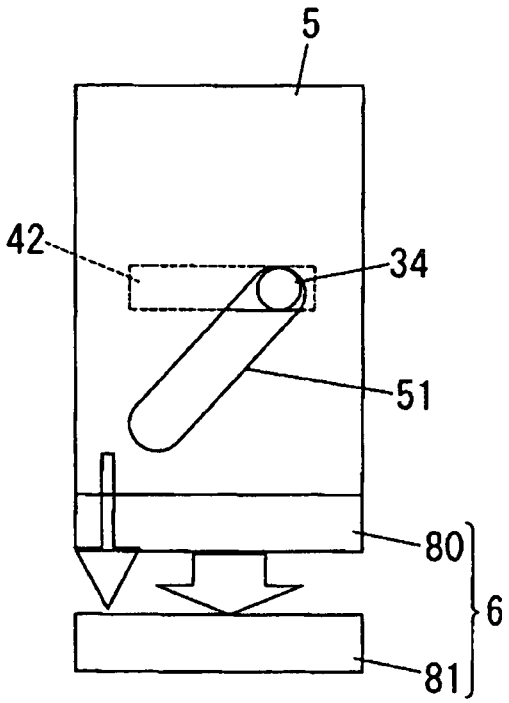
Figure 7A:
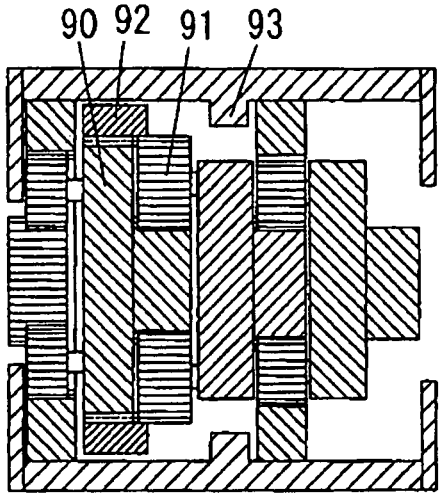
FIG. 7A (PRIOR ART)
FIGS. 7A to 7C are reference views for explaining a conventional speed reduction mechanism.
Figure 7B:
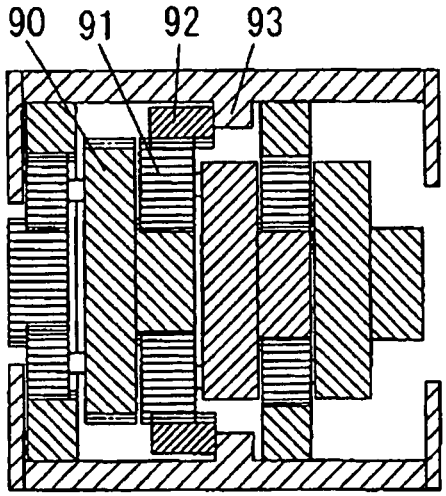
FIG. 7B (PRIOR ART)
Figure 7C:
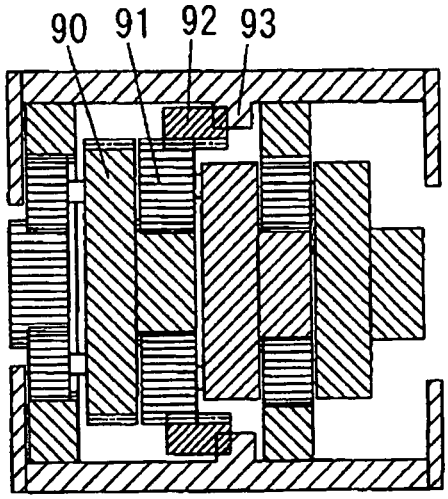
FIG. 7C (PRIOR ART)

Next, a third embodiment of the present invention will be described with reference to FIGS. 6A to 6C. Since the third embodiment has the same structure as that of the first embodiment except for the configuration of the biasing unit 6, the difference therebetween will mainly be described without the redundant descriptions.

In the electric power tool in accordance with the third embodiment of the present invention, the biasing unit 6 includes a pair of magnets 80 and 81 respectively provided at one circumferential end of the rotary plate 5 and a portion of the reducer case 4 such that they are arranged opposite to each other. The magnets 80 and 81 are configured to selectively have opposite magnetic poles for mutual magnetic attraction or same magnetic poles for mutual magnetic repulsion. In the electric power tool of the present embodiment, at least one of the magnets 80 and 81 is formed of an electromagnet.

Accordingly, it is possible to continuously apply a rotational force to the rotary plate 5 by the pressing force caused by the magnetic force even when the movable member 34 is temporarily unable to be moved due to the contact with the facing surface of a target member to be engaged therewith (e.g., the fixed teeth 41 or the teeth of the carrier 24 of the first planetary gear train 21). When a force is downwardly applied to the rotary plate 5 as shown in FIGS. 6A to 6C, the operation slot 51 can continuously apply a pressing force to the supporting member 34 in the moving direction thereof. Therefore, it is possible to reliably allow the movable member 32 and the target member to be engaged with each other.

Unlike the first and the second embodiment, it is unnecessary to generate a force great enough to deform the elastic bodies 61 or the thin parts 62 in the electric power tool of the present embodiment. In other words, in the electric power tool of the present embodiment, excessive friction is not generated between the supporting member 34 and the operation slot 51, since the rotary plate 5 is merely rotated by the magnetic force instead of a stronger force applied from the driving unit 7. Accordingly, it is possible to reduce the parts where the excessive friction is generated, to thereby suppress the deterioration of components.

Although the electric power tool of the present invention is described through the above embodiments, it is not limited to the above embodiments. Further, even though the ring gear 31 is used as the movable member 32 in the above embodiments, the movable member is not limited to the ring gear in the electric power tool of the present invention.

While the invention has been shown and described with respect to the embodiments, it will be understood by those skilled in the art that various changes and modifications may be made without departing from the scope of the invention as defined in the following claims.

What is claimed is:

1. An electric power tool including a motor accommodated in a housing and serving as a drive power source; a speed reduction mechanism for transferring a rotational driving force to a tool part provided at a front side of the housing; and a cylindrical reducer case, accommodated in the housing and accommodating therein the speed reduction mechanism, wherein the speed reduction mechanism includes a planetary gear train and a movable member which is slidable in an axial direction of the planetary gear train to be engaged with or disengaged from the planetary gear train, and a reduction ratio thereof is changeable at a plurality of stages by controlling the movement of the movable member, the electric power tool comprising:

the reducer case including a slide hole formed through a sidewall of the reducer case and extended along the axial direction;

a rotary plate which is rotatable around a periphery of the reducer case about the axis, the rotary plate including an operation slot formed obliquely with respect to the axial direction and overlapped with the slide hole and a biasing unit;

a supporting member radially outwardly protruded from the movable member and extended through the slide hole and the operation slot; and a driving unit configured to drive the rotary plate along the periphery of the reducer case, wherein the biasing unit applies a pressing force to the supporting member in a moving direction of the supporting member when the rotary plate is rotated to a position by the driving unit.

2. The electric power tool of claim 1, wherein the biasing unit generates the pressing force when the movable member is unable to be moved immediately before reaching a changeover position.

3. The electric power tool of claim 2, wherein the biasing unit is an elastic body provided at a side of the operation slot, exclusive of longitudinal opposite ends of the operation slot.

4. The electric power tool of claim 2, wherein an elastic force applying groove is formed along the operation slot to form a thin part between the operation slot and the elastic force applying groove, and the thin part serves as the biasing unit.

5. The electric power tool of claim 1, wherein the biasing unit is an elastic body provided at a side of the operation slot, exclusive of longitudinal opposite ends of the operation slot.

6. The electric power tool of claim 1, wherein an elastic force applying groove is formed along the operation slot to form a thin part between the operation slot and the elastic force applying groove, and the thin part serves as the biasing unit.

7. An electric power tool including a motor accommodated in a housing and serving as a drive power source; a speed reduction mechanism for transferring a rotational driving force to a tool part provided at a front side of the housing; and a cylindrical reducer case, accommodated in the housing and accommodating therein the speed reduction mechanism, wherein the speed reduction mechanism includes a planetary gear train and a movable member which is slidable in an axial direction of the planetary gear train to be engaged with or disengaged from the planetary gear train, and a reduction ratio thereof is changeable at a plurality of stages by controlling the movement of the movable member, the electric power tool comprising:

the reducer case including a slide hole formed through a sidewall of the reducer case and extended along the axial direction;

a rotary plate which is rotatable around a periphery of the reducer case about the axis, the rotary plate including an operation slot formed obliquely with respect to the axial direction and overlapped with the slide;

a supporting member radially outwardly protruded from the movable member and extended through the slide hole and the operation slot;

a driving unit configured to drive the rotary plate along the periphery of the reducer case; and a biasing unit configured to apply a pressing force to the supporting member in a moving direction of the supporting member when the rotary plate is rotated to a position by the driving unit, wherein the biasing unit includes a pair of magnets respectively provided at one circumferential end of the rotary plate and a portion of the reducer case such that they are arranged opposite to each other.

8. The electric power tool of claim 7, wherein the biasing unit generates the pressing force when the movable member is unable to be moved immediately before reaching a changeover position.

* * * * *